US011639651B2

(12) United States Patent
Al-Wadie

(10) Patent No.: US 11,639,651 B2
(45) Date of Patent: May 2, 2023

(54) BOOSTING PRODUCTION FROM LOW PRESSURE OR DEAD WELLS

(71) Applicant: Saudi Arabian Oil Company, Dhahran (SA)

(72) Inventor: Hesham Dhafer Al-Wadie, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/216,145

(22) Filed: Mar. 29, 2021

(65) Prior Publication Data

US 2021/0215031 A1 Jul. 15, 2021

Related U.S. Application Data

(63) Continuation of application No. 16/656,073, filed on Oct. 17, 2019.

(51) Int. Cl.

| | |
|---|---|
| ***E21B 43/12*** | (2006.01) |
| ***E21B 43/40*** | (2006.01) |
| ***F04F 5/20*** | (2006.01) |
| ***F04F 5/24*** | (2006.01) |
| ***F04F 5/36*** | (2006.01) |

(52) U.S. Cl.

CPC ..... *E21B 43/124* (2013.01); *E21B 43/40* (2013.01); *F04F 5/20* (2013.01); *F04F 5/24* (2013.01); *F04F 5/36* (2013.01); *E21B 43/121* (2013.01)

(58) Field of Classification Search

CPC ..... E21B 43/40; E21B 43/124; E21B 43/121; E21B 43/16; E21B 43/18; E21B 43/34; F04F 5/20; F04F 5/24; F04F 5/36

See application file for complete search history.

(56) References Cited

U.S. PATENT DOCUMENTS

| | | | | |
|---|---|---|---|---|
| 2,937,140 | A | 5/1960 | Stinson | |
| 5,195,587 | A * | 3/1993 | Webb | E21B 43/40 166/267 |
| 5,314,613 | A * | 5/1994 | Russo | C10M 175/005 208/185 |
| 6,120,254 | A | 9/2000 | Popov | |
| 6,132,494 | A | 10/2000 | Kjos | |
| 6,162,021 | A | 12/2000 | Sarshar et al. | |

(Continued)

FOREIGN PATENT DOCUMENTS

| | | | |
|---|---|---|---|
| GB | 2450565 | 12/2008 | |
| GB | 2450565 A * | 12/2008 | E21B 43/121 |
| GB | 2526820 A * | 12/2015 | E21B 43/00 |

OTHER PUBLICATIONS

GCC Examination Report in Gulf Cooperation Council Appln. No. GC 2020-40668, dated Dec. 1, 2021, 4 pages.

(Continued)

*Primary Examiner* — Nathan C Zollinger

(74) *Attorney, Agent, or Firm* — Fish & Richardson P.C.

(57) ABSTRACT

A gas-oil separation plant (GOSP) is configured to process crude oil produced from a well. A production stream from the well operates at a first pressure. A processed crude oil stream from the GOSP flows to a multi-phase ejector. The multi-phase ejector induces flow of a production stream from the well in response to the flow of the processed crude oil stream.

9 Claims, 4 Drawing Sheets

(56) References Cited

U.S. PATENT DOCUMENTS

| | | | | |
|---|---|---|---|---|
| 6,296,453 | B1 * | 10/2001 | Layman | F04F 5/54 417/151 |
| 9,670,765 | B2 | 6/2017 | Magi et al. | |
| 10,167,706 | B2 * | 1/2019 | Beg | F04F 5/54 |
| 2015/0267523 | A1 | 9/2015 | Saponja et al. | |
| 2016/0138372 | A1 | 5/2016 | Beg | |
| 2016/0265322 | A1 | 9/2016 | Beg | |
| 2018/0133621 | A1 * | 5/2018 | Titley | B01D 19/0063 |

OTHER PUBLICATIONS

PCT International Search Report and Written Opinion in International Appln. No. PCT/US2020/055531, dated Jan. 28, 2021, 16 pages.

Leagas et al, "Ejector Technology for Efficient and Cost Effective Flare Gas Recovery," Proceedings of the GPA-GCC 24th Annual Technical Conference, Kuwait City, Kuwait, May 10-11, 2016, pp. 1-10, 10 pages.

Peeran et al, "Boosting Production from Low Pressure Wells and Reviving Dead Wells Using Surface Mounted Technology and Avoiding Well Intervention," SPE-184010-MS, Society of Petroleum Engineers (SPE), SPE Middle East Oil & Gas Show and Conference, Mar. 2017, 10 pages.

Sonawat et al, "Flare Gas Recovery using Ejector—A Review," Proceedings of the Thirty Ninth National Conference on Fluid Mechanics and Fluid Power Dec. 13-15, 2012, SVNIT Surat, Gujarat, India FMFP201282, 1-8, 9 pages.

Transvac, "Ejector Solutions for the Oil & Gas Industry," Transvac Systems Ltd., brochure, 8 pages.

Transvac, "Ejector Solutions: Enhanced Recovery and Production Solutions," Transvac Systems Ltd., 18-19, 28 pages.

Transvac, "Ejector Solutions: Flare Gas Recovery & Zero Flare Solutions," Transvac Systems Ltd., 16 pages.

transvac.co.uk [online] "Ejectors for the Oil & Gas Industry," Transvac, available on or before Mar. 28, 2006, retrieved from URL <https://www.transvac.co.uk/oilandgas.htm>, 8 pages.

Villa et al, "Ejector for Boosting Low-Pressure Oil Wells," SPE Prod. & Facilities 14:4 (229-234), Nov. 1999, 6 pages.

* cited by examiner

BOOSTING PRODUCTION FROM LOW PRESSURE OR DEAD WELLS

CROSS-REFERENCE TO RELATED APPLICATIONS

This application is a continuation of U.S. patent application Ser. No. 16/656,073, filed on Oct. 17, 2019, which is hereby incorporated by reference in its entirety.

TECHNICAL FIELD

This disclosure relates to hydrocarbon production from wells.

BACKGROUND

Rocks in a hydrocarbon reservoir store hydrocarbons (for example, petroleum, oil, gas, or combinations of one or more of these), for example, by trapping the hydrocarbons within porous formations in the rocks. These hydrocarbons can be retrieved from the reservoir via one or more wells drilled into the formation. Commercial-scale hydrocarbon production from such source rocks and reservoirs requires significant capital. It is therefore beneficial to optimize cost and design of development to extract as much hydrocarbons as possible from the reservoir within a reasonable amount of time for commercial viability.

SUMMARY

This disclosure describes technologies relating to boosting or reviving production from low pressure or dead wells.

In a first general aspect, a method can be implemented for boosting or reviving production from a well connected to a gas-oil separation plant. At least a portion of a processed crude oil stream from a pump in the gas-oil separation plant is flowed to a multi-phase ejector as motive fluid. The processed crude oil stream flows to the multi-phase ejector at a first pressure. The multi-phase ejector is in fluid communication with the well. Pressure energy of the portion of the processed crude oil stream is converted into kinetic energy by the multi-phase ejector, thereby reducing pressure within the multi-phase ejector and inducing flow of a production stream from the well to the multi-phase ejector as suction fluid. The production stream flows to the multi-phase ejector at a second pressure less than the first pressure. The suction fluid and the motive fluid are mixed by the multi-phase ejector. The mixture of the suction fluid and the motive fluid is discharged by the multi-phase ejector at an intermediate pressure between the first pressure and the second pressure. The mixture of the suction fluid and the motive fluid at the intermediate pressure is flowed to a separator in the gas-oil separation plant.

In a second general aspect, a processed crude oil stream is flowed by a pump of a gas-oil separation plant at a first pressure to a multi-phase ejector. The multi-phase ejector is fluidically coupled to the pump and fluidically coupled to a well. A low-pressure area is created by the multi-phase ejector responsive to flowing the processed crude oil stream, thereby inducing flow of a production stream from the well to the multi-phase ejector at a second pressure less than the first pressure. A pressure in the low-pressure area is less than the second pressure of the production stream.

In a third general aspect, a system includes a multi-phase ejector and a pump in a gas-oil separation plant. The multi-phase ejector is fluidically coupled to a well. The pump is fluidically coupled to the multi-phase ejector. The pump is configured to flow a processed crude oil stream as motive fluid to the multi-phase ejector at a first pressure. The multi-phase ejector is configured to create a low-pressure area in response to the flow of the processed crude oil stream, thereby inducing flow of a production stream from the well as suction fluid to the multi-phase ejector at a second pressure less than the first pressure. A pressure in the low-pressure area is less than the second pressure.

Implementations of the first, second, and third general aspects may include one or more of the following features.

The separator can be a low pressure production trap, and another portion of the production stream from the well can be flowed to a high pressure production trap in the gas-oil separation plant.

In some implementations, a remaining portion of the processed crude oil stream from the pump is flowed to the low pressure production trap.

In some implementations, the second pressure is at most 120 pounds per square inch gauge (psig).

In some implementations, the first pressure is at least 200 psig.

In some implementations, the intermediate pressure is about 60 psig.

A mixture of the processed crude oil stream and the production stream can be discharged by the multi-phase ejector at an intermediate pressure between the first pressure and the second pressure.

In some implementations, the multi-phase ejector is configured to receive, as suction fluid, multiple production streams from multiple wells. Each of the production streams can be from a different one of the wells.

The multi-phase ejector can be configured to discharge a mixture of the processed crude oil stream and the production stream at an intermediate pressure between the first pressure and the second pressure.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes boosting production from wells, for example, dead or low flow wellhead pressure wells. The subject matter described in this disclosure can be implemented in particular implementations, so as to realize one or more of the following advantages. Implementation of the subject matter can capitalize on the existing infrastructure and available resources by utilizing the energy from the shipping pumps' discharge lines to boost the production from low pressure oil wells, revive dead wells, or both. This boost in production can be achieved by installing a multi-phase ejector on a branch from the discharge line of one or more shipping pumps. This flow from the shipping pump(s)

(once it passes through the ejector) will significantly drop in pressure, resulting in a sonic velocity at the neck and supersonic velocity at the exit of the ejector's convergent nozzle. This drop in pressure within the ejector can stimulate the flow from low pressure wells. The high velocity flow, which includes hydrocarbons from the low pressure well and the shipping pump, passes through the rest of the ejector (a divergent cone), which converts kinetic energy back into pressure. Production from a well can be boosted without requiring the need of additional rotating equipment. In contrast, production can be boosted with addition of static equipment (a multi-phase ejector), which can incur less capital, operating, and maintenance costs than rotating equipment. Production from the well can be boosted without increasing loads to the flare, thereby avoiding increasing emissions. The systems and methods described can be implemented in connection to a new system or be retro-fitted to an existing system.

Figure 1:
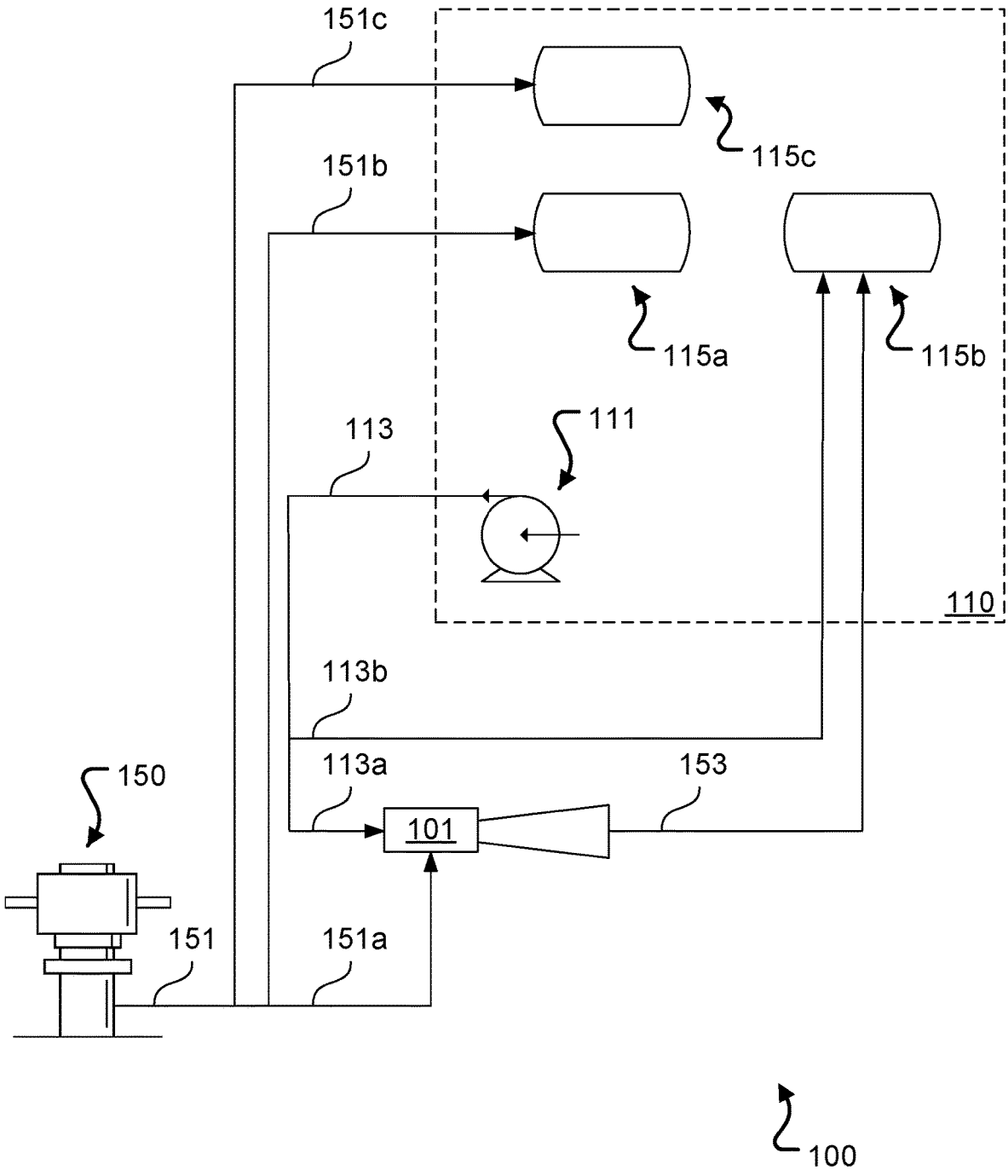
FIG. 1 is a schematic diagram of an example system that can be used to boost or revive production from a well.

FIG. 1 shows an example system 100 that can be used to boost production from a well 150. The system 100 includes a multi-phase ejector 101 and a pump 111 in a gas-oil separation plant (GOSP) 110. The multi-phase ejector 101 is fluidically coupled to a well 150 and to the pump 111. Although only a Christmas tree (150) is shown in FIG. 1, the well 150 includes additional components for producing fluids from a subterranean zone. The well 150 extends from the surface through the Earth to one or more subterranean zones of interest, and the well 150 enables access to the subterranean zone(s) of interest to allow recovery (that is, production) of fluids to the surface and, in some implementations, additionally or alternatively allows fluid(s) to be placed in the Earth. The subterranean zone can include, for example, a formation, a portion of a formation, or multiple formations in a hydrocarbon-bearing reservoir from which recovery operations can be practiced to recover trapped hydrocarbons.

The production stream 151 from the well 150 includes hydrocarbons, for example, crude oil, natural gas, or both. The production stream 151 can include additional components, such as water, contaminants, or both.

The GOSP 110 is configured to process crude oil, for example, the production stream 151 or a portion of the production stream 151 produced from the well 150. Processing in the GOSP 110 can include, for example, removal of contaminants, removal of water, separation of gas and oil phases, or any combination of these. The GOSP 110 can include various types of equipment to carry out such processes, for example, pumps, compressors, valves, heat exchangers, separators, catalysts, and demulsifiers. The product streams exiting the GOSP 110 can include a processed crude oil stream (for example, the processed crude oil stream 113), a natural gas stream, or both.

In some implementations, the GOSP 110 includes a high pressure production trap 115*a*, a low pressure production trap 115*b*, and a high pressure test trap 115*c*. All of these (115*a*, 115*b*, and 115*c*) can be considered specialized separators. The high pressure production trap 115*a* can include a three-phase separator for separating oil, water, and gas. The high pressure production trap 115*a* operates at a greater pressure than the low pressure production trap 115*b*. In some implementations, the high pressure production trap 115*a* operates at about 120 pounds per square inch gauge (psig), about 115 psig, about 110 psig, about 105 psig, about 100 psig, or less. The low pressure production trap 115*b* can include a two-phase separator for separating oil and gas. In some implementations, the low pressure production trap 115*b* operates at about 50 psig, about 45 psig, about 40 psig, about 35 psig, about 30 psig, or less. The high pressure test trap 115*c* can include a two-phase separator. The high pressure test trap 115*c* can be used for testing to identify characteristics of the well's production or revival. In some implementations, similar to the high pressure production trap 115*a*, the high pressure test trap 115*c* operates at about 120 psig, about 115 psig, about 105 psig, about 100 psig, or less.

The processed crude oil stream 113 is the oil product stream from the GOSP 110. In comparison to the production stream 151, the processed crude oil stream 113 has less water content and less contaminants. Gaseous components originating from the production stream 151 have also been separated out from the processed crude oil stream 113.

Although not shown, the GOSP 110 can produce multiple processed crude oil streams that are not recycled to the GOSP 110 like the processed crude oil stream 113. The additional processed crude oil stream(s) can be delivered, for example, to another user of processed crude oil or to another facility for further processing (for example, fractionation).

The multi-phase ejector 101 is configured to receive at least a portion 113*a* of the processed crude oil stream 113 as motive fluid. The portion 113*a* of the processed crude oil stream 113 can flow to the multi-phase ejector 101 as a liquid phase at a first pressure. The first pressure can depend on various factors, such as dimensions and speed of the pump 111, configurations of one or more flow control devices (for example, % opening of a flow control valve), and existence of other flow restrictions (for example, a flow orifice). In some implementations, the first pressure is at least 200 psig. For example, the first pressure can be about 210 psig, about 220 psig, about 230 psig, about 240 psig, about 250 psig, or greater.

The multi-phase ejector 101 is configured to receive at least a portion 151*a* of the production stream 151 as suction fluid. The portion 151*a* of the production stream 151 can flow to the multi-phase ejector 101 as a liquid phase, a gas phase, or a mixed phase (for example, a mixture of liquid and gas) at a second pressure less than the first pressure. The second pressure can depend on various factors, such as available pressure in the subterranean formation and flow restrictions in the well 150. In some implementations, the second pressure is at most 120 pounds per square inch gauge (psig). For example, the second pressure can be about 110 psig, about 100 psig, about 90 psig, about 80 psig, about 70 psig, about 60 psig, about 50 psig, about 40 psig, about 30 psig, about 20 psig, about 10 psig, or less.

Within the multi-phase ejector 101, the motive fluid induces the suction fluid to flow. The design of the multi-phase ejector 101 takes advantage of the Venturi effect and converts pressure energy into kinetic energy, thereby reducing the pressure and enabling the ejector 101 to induce flow of the portion 151*a* production stream 151 into the ejector 101 as suction fluid. This induced flow of the production stream 151 by the ejector 101 provides the boost in production from the well 150.

The multi-phase ejector 101 is configured to mix the suction fluid and the motive fluid. As the mixture of the suction fluid and the motive fluid flows through the multi-phase ejector 101 some of the kinetic energy is converted back into pressure energy. The multi-phase ejector 101 is configured to discharge the mixture 153 of the suction fluid and the motive fluid at an intermediate pressure that is between the first pressure and the second pressure. In some implementations, the intermediate pressure is in a range of from about 10 psig to about 200 psig, for example, in a range of from about 10 psig to about 120 psig. For example, the intermediate pressure can be about 20 psig, about 30 psig, about 40 psig, about 50 psig, about 60 psig, about 70 psig, about 80 psig, about 90 psig, about 100 psig, or about 110 psig.

The mixture 153 of the suction fluid and the motive fluid at the intermediate pressure can be a mixed phase (for example, a mixture of liquid and gas). The mixture 153 of the suction fluid and the motive fluid at the intermediate pressure can be flowed to the GOSP 110 to be processed. In some implementations, the mixture 153 is flowed to the low pressure production trap 115*b*. In some implementations, the high pressure production trap 115*a* is configured to receive a portion 151*b* of the production stream 151 from the well 150. In some implementations, the low pressure production trap 115*b* is configured to receive a portion 113*b* of the processed crude oil stream 113 from the pump 111. In some implementations, the high pressure test trap 115*c* is configured to receive a portion 151*c* of the production stream 151 from the well 150.

Figure 2:
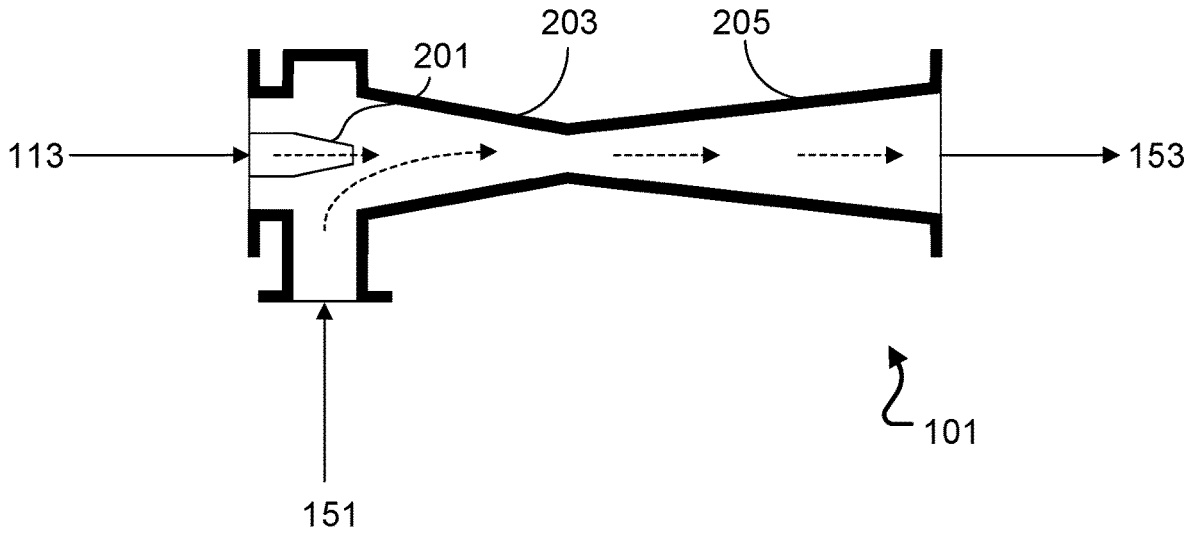
FIG. 2 is a schematic diagram of an example ejector of the system shown in FIG. 1.

FIG. 2 shows an example ejector 101 that can be implemented in system 100. The ejector 101 can include a nozzle 201 for motive fluid. The ejector 101 can include a convergent conical section 203 and a divergent conical section 205. As motive fluid (for example, the portion 113*a* of the processed crude oil stream 113) flows through the nozzle 201, pressure energy is converted to kinetic energy, and a low-pressure area is created downstream of the nozzle 201 within the ejector 101. The decreased pressure in the low-pressure area induces flow of suction fluid (for example, the portion 151*a* of the production stream 151) into the ejector 101. The motive fluid and the suction fluid mix as they flow through the convergent conical section 203. As the mixture of motive fluid and suction fluid flows through the divergent conical section 205, some of the kinetic energy is converted back into pressure energy. The mixture is then discharged from the ejector 101 at an intermediate pressure that is less than the pressure of the motive fluid entering the ejector 101 (for example, the first pressure) and greater than the pressure of the suction fluid entering the ejector 101 (for example, the second pressure). The ejector 101 can be of a robust design, such that the ejector 101 can handle a full range of mixed phase for its suction fluid (that is, stream 151 can range from fully vapor to fully liquid and any vapor-liquid ratio in between) and liquid phase for its motive fluid (stream 113).

Figure 3:
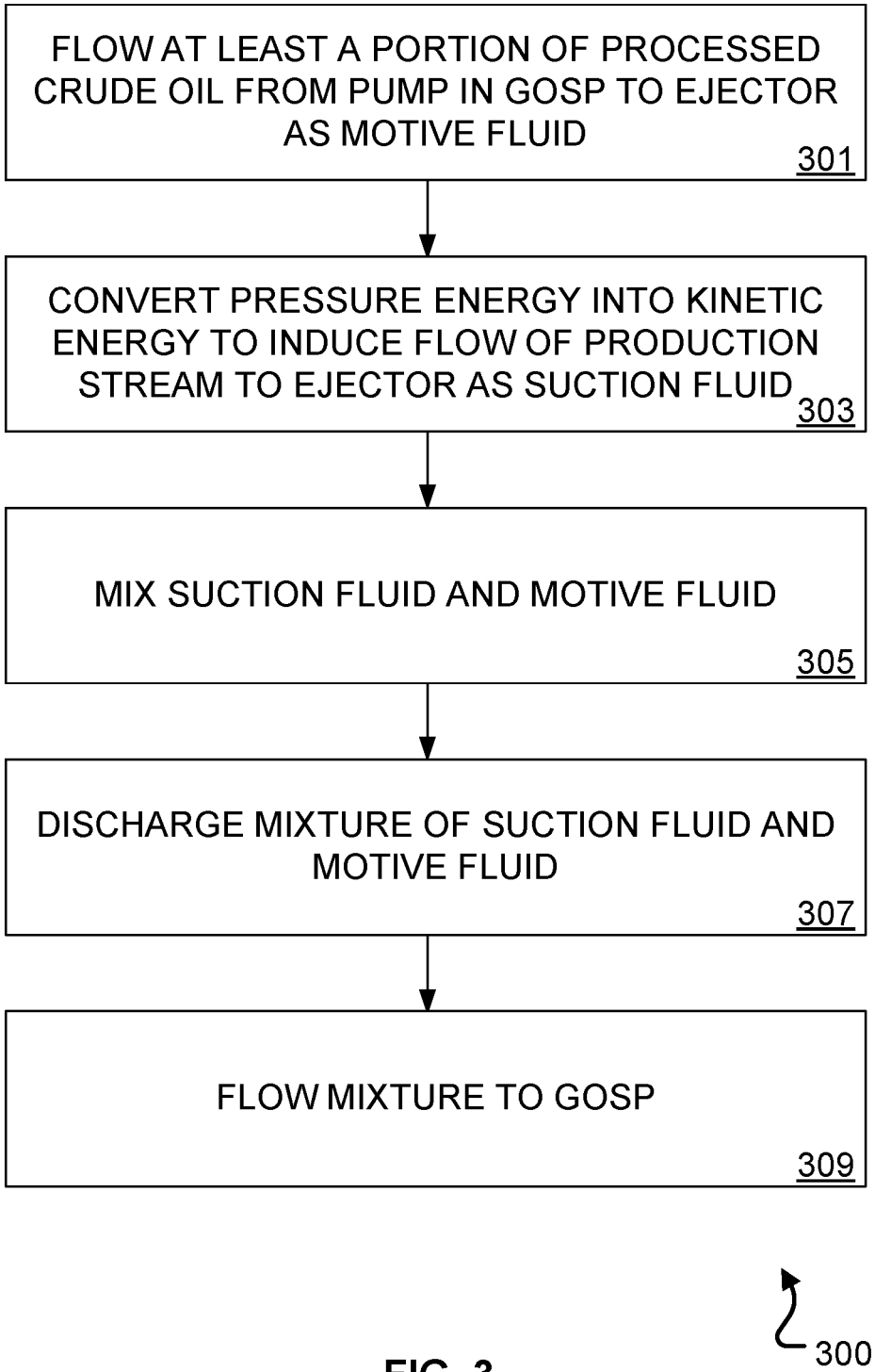
FIG. 3 is a flow chart of an example method for boosting or reviving production from a well.

FIG. 3 is a flow chart of an example method 300 for boosting or reviving production from a well (for example, the well 150) that is connected to a GOSP (for example, the GOSP 110). The system 100 can be used to implement method 300. At step 301, at least a portion of a processed crude oil stream (for example, portion 113*a* of processed crude oil stream 113) is flowed from a pump (for example, pump 111) in the GOSP 110 to a multi-phase ejector (for example, the multi-phase ejector 101) as motive fluid. The multi-phase ejector 101 is in fluid communication with the well 150. The motive fluid can flow to the multi-phase ejector 101 at a first pressure. In some implementations, the first pressure is at least 200 psig. For example, the first pressure can be about 210 psig, about 220 psig, about 230 psig, about 240 psig, about 250 psig, or greater. In some implementations, a remaining portion of the processed crude oil stream 113 (for example, portion 113*b*) is flowed to a separator in the GOSP 110 (for example, the low pressure production trap 115*b*).

At step 303, pressure energy of the portion 113*a* of the processed crude oil stream 113 is converted into kinetic energy by the multi-phase ejector 101, thereby reducing pressure within the multi-phase ejector 101 and inducing flow of at least a portion of a production stream (for example, portion 151*a* of production stream 151) from the well 150 to the multi-phase ejector 101 as suction fluid. The suction fluid can flow to the multi-phase ejector at a second pressure that is less than the first pressure. In some implementations, the second pressure is at most 120 psig. For example, the second pressure can be about 110 psig, about 100 psig, about 90 psig, about 80 psig, about 70 psig, about 60 psig, about 50 psig, about 40 psig, about 30 psig, about 20 psig, about 10 psig, about 5 psig, or less. In some implementations, another portion of the production stream 151 (is flowed to a separator in the GOSP 110. For example, the portion 151*b* of the production stream 151 is flowed to the high pressure production trap 115*a*. For example, the portion 151*c* of the production stream 151 is flowed to the high pressure test trap 115*c*.

At step 305, the suction fluid and the motive fluid are mixed by the multi-phase ejector 101. As described previously, within the multi-phase ejector 101, the drop in pressure of the motive fluid induces the flow of the suction fluid. The design of the multi-phase ejector 101 takes advantage of the Venturi effect and converts pressure energy into kinetic energy. After passing through a convergent combining cone, the mixture of the suction fluid and the motive fluid enters a divergent delivery cone, which slows down the flow of fluid through the multi-phase ejector 101, thereby converting kinetic energy back into pressure energy.

At step 307, the mixture of the suction fluid and the motive fluid is discharged by the multi-phase ejector 101 at an intermediate pressure that is between the first pressure and the second pressure. In some implementations, the intermediate pressure is in a range of from about 10 psig to about 200 psig, for example, in a range of from about 10 psig to about 120 psig. For example, the intermediate pressure can be about 20 psig, about 30 psig, about 40 psig, about 50 psig, about 60 psig, about 70 psig, about 80 psig, about 90 psig, about 100 psig, or about 110 psig.

At step 309, the mixture of the suction fluid and the motive fluid (discharged from the multi-phase ejector 101 at step 307) is flowed to a separator in the GOSP 110 (for example, the low pressure production trap 115*b*). The mixture can undergo processing in the GOSP 110, for example, to produce at least a portion of the processed crude oil stream 113 exiting the GOSP 110, a natural gas stream, or both.

Figure 4:
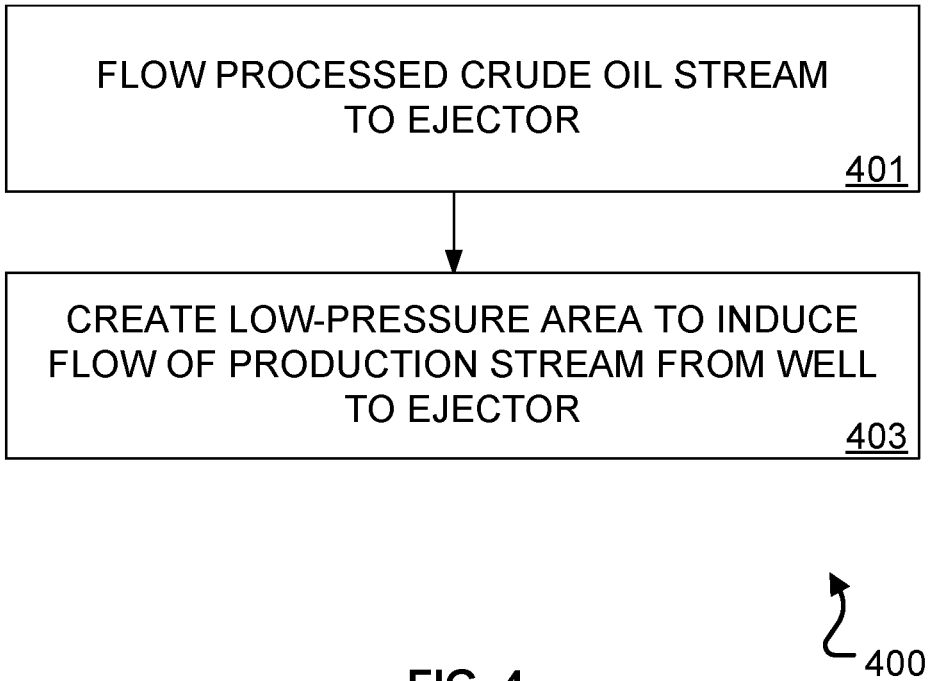
FIG. 4 is a flow chart of an example method that can be implemented by the system shown in FIG. 1.

FIG. 4 is a flow chart of an example method 400 that can be implemented, for example, to boost or revive production from a well (for example, the well 150). The system 100 can be used to implement method 400. At step 401, a processed crude oil stream (for example, the processed crude oil stream 113 or the portion 113*a* of the processed crude oil stream 113) is flowed by a pump (for example, the pump 111) of a GOSP (for example, the GOSP 110) to a multi-phase ejector (for example, the multi-phase ejector 101) at a first pressure. The processed crude oil stream 113 is flowed to the ejector 101 as motive fluid. The multi-phase ejector 101 is fluidically coupled to the pump 111 and fluidically coupled to the well 150. In some implementations, the first pressure is at least 200 psig. For example, the first pressure can be about 210 psig, about 220 psig, about 230 psig, about 240 psig, about 250 psig, or greater.

At step 403, a low-pressure area is created by the multi-phase ejector 101 in response to flowing the processed crude oil stream 113 at step 401. The creation of the low-pressure area by the multi-phase ejector 101 at step 403 induces flow of a production stream (for example, the production stream 151 or the portion 151*a* of the production stream 151) from the well 150 to the multi-phase ejector 101 at a second pressure that is less than the first pressure. The pressure in the low-pressure area is less than the second pressure of the production stream 151, so that the production stream 151 can flow to the ejector 101 as suction fluid. In some implementations, the second pressure is at most 120 psig. For example, the second pressure can be about 110 psig, about 100 psig, about 90 psig, about 80 psig, about 70 psig, about 60 psig, about 50 psig, about 40 psig, about 30 psig, about 20 psig, about 10 psig, about 5 psig, or less.

The processed crude oil stream 113 and the production stream 151 can mix within the ejector 101. The mixture of the processed crude oil stream 113 and the production stream 151 can be discharged by the ejector 101 at an intermediate pressure that is between the first pressure and the second pressure. In some implementations, the intermediate pressure is in a range of from about 10 psig to about 200 psig, for example, in a range of from about 10 psig to about 120 psig. For example, the intermediate pressure can be about 20 psig, about 30 psig, about 40 psig, about 50 psig, about 60 psig, about 70 psig, about 80 psig, about 90 psig, about 100 psig, or about 110 psig.

It is noted that an alternative, conventional method for continuing production from a well that has lost pressure (for example, the well 150) is to decrease an operating pressure of the GOSP 110. For example, the operating pressure of the high pressure production trap 115*a* can be decreased to a point at which fluids can still be produced from the well 150 and flow to the high pressure production trap 115*a* without the use of the ejector 101. This conventional method, however, can result in the need of sending flow to the flare, for example, due to the increased flow of gas that flashes from the liquid at decreased pressure. Increased flow to the flare is especially prevalent in cases where the pressure drops to less than the operating pressure of the low pressure production trap 115*b*. Sending more flow to the flare increases emissions of the GOSP 110. By implementing the systems and methods described here (and specifically implementing the multi-phase ejector 101), the risk of sending additional flow to the flare can be mitigated or, in some cases, eliminated.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

flowing, by a pump of a gas-oil separation plant, a processed crude oil stream at a first pressure to a multi-phase ejector fluidically coupled to the pump and fluidically coupled to a well;

creating, by the multi-phase ejector, a low-pressure area responsive to flowing the processed crude oil stream, thereby inducing flow of a production stream from the well to the multi-phase ejector at a second pressure less than the first pressure, wherein a pressure in the low-pressure area is less than the second pressure of the production stream;

flowing a mixture of the processed crude oil stream and a first portion of the production stream from the multi-phase ejector to a low pressure production trap of the gas-oil separation plant;

flowing a second portion of the production stream from the well to a high pressure production trap of the gas-oil separation plant; and flowing a third portion of the production stream from the well to a high pressure test trap of the gas-oil separation plant, wherein the flow of the production stream from the well is induced without decreasing an operating pressure of the high pressure production trap, thereby avoiding increasing a load to a flare of the gas-oil separation plant.

2. The method of claim 1, comprising discharging, by the multi-phase ejector, a mixture of the processed crude oil stream and the first portion of the production stream at an intermediate pressure between the first pressure and the second pressure.

3. The method of claim 2, wherein the first pressure is at least 200 pounds per square inch gauge (psig) and up to about 250 psig, and the second pressure is at most 120 psig.

4. The method of claim 3, wherein the intermediate pressure is about 60 psig.

5. A system comprising:

a multi-phase ejector fluidically coupled to a well;

a pump in a gas-oil separation plant fluidically coupled to the multi-phase ejector, the pump configured to flow a processed crude oil stream as motive fluid to the multi-phase ejector at a first pressure, wherein the multi-phase ejector is configured to create a low-pressure area in response to the flow of the processed crude oil stream, thereby inducing flow of a production stream from the well as suction fluid to the multi-phase ejector at a second pressure less than the first pressure, wherein a pressure in the low-pressure area is less than the second pressure;

a low pressure production trap in the gas-oil separation plant, wherein the multi-phase ejector is configured to discharge a mixture of the processed crude oil stream and a first portion of the production stream to the low pressure production trap;

a high pressure production trap in the gas-oil separation plant, wherein the high pressure production trap is configured to receive a second portion of the production stream from the well; and a high pressure test trap in the gas-oil separation plant, wherein the high pressure test trap is configured to receive a third portion of the production stream from the well, wherein the multi-phase ejector is configured to induce the flow of the production stream from the well without decreasing an operating pressure of the high pressure production trap, thereby avoiding increasing a load to a flare in the gas-oil separation plant.

6. The system of claim 5, wherein the multi-phase ejector is configured to receive, as suction fluid, a plurality of production streams from a respective plurality of wells.

7. The system of claim 5, wherein the multi-phase ejector is configured to discharge a mixture of the processed crude oil stream and the first portion of the production stream at an intermediate pressure between the first pressure and the second pressure.

8. The system of claim 7, wherein the first pressure is at least 200 pounds per square inch gauge (psig) and up to about 250 psig, and the second pressure is at most 120 psig.

9. The system of claim 8, wherein the intermediate pressure is about 60 psig.

* * * * *